US005558052A

United States Patent [19]

Schwarzenthal et al.

[11] Patent Number: 5,558,052

[45] Date of Patent: Sep. 24, 1996

[54] INTERNAL-COMBUSTION ENGINE SWITCHABLE VALVE TAPPET

[75] Inventors: Dietmar Schwarzenthal, Ditzingen; Joachim Gruenberger, Sachsenheim, both of Germany

[73] Assignee: Dr. Ing. h.c.F. Porsche AG, Germany

[21] Appl. No.: 390,998

[22] Filed: Feb. 21, 1995

[30] Foreign Application Priority Data

Feb. 18, 1994 [DE] Germany ..... 44 05 190.5
Dec. 15, 1994 [DE] Germany ..... 44 44 698.5

[51] Int. Cl.[6] ..... F01L 1/12; F01L 13/00; F02D 13/06

[52] U.S. Cl. ..... 123/90.16; 123/198 F; 74/569

[58] Field of Search ..... 123/90.15, 90.16, 123/90.48, 198 F; 74/569

[56] References Cited

U.S. PATENT DOCUMENTS

| | | | |
|---|---|---|---|
| 4,711,207 | 12/1987 | Bonvallet | 123/90.16 |
| 4,770,137 | 9/1988 | Okabe et al. | 123/198 F |
| 5,203,289 | 4/1993 | Hara et al. | 123/90.16 |
| 5,343,833 | 9/1994 | Shirai | 123/90.16 |
| 5,345,904 | 9/1994 | Dopson et al. | 123/198 F |
| 5,351,662 | 10/1994 | Dopson et al. | 123/198 F |
| 5,361,734 | 11/1994 | Shirai | 123/198 F |
| 5,402,756 | 4/1995 | Bohme et al. | 123/198 F |
| 5,431,133 | 7/1995 | Spath et al. | 123/90.16 |

FOREIGN PATENT DOCUMENTS

| | | | |
|---|---|---|---|
| 2814308 | 10/1979 | Germany | 123/198 F |
| 2952037A1 | 6/1981 | Germany . | |
| 4219435A1 | 12/1993 | Germany . | |
| WO93/18284 | 9/1993 | WIPO . | |

*Primary Examiner*—Weilun Lo
*Attorney, Agent, or Firm*—Evenson, McKeown, Edwards & Lenahan

[57] ABSTRACT

A tappet is provided with a hydraulically actuated piston and a clutch member so that the valve is inoperative in a first switching position, whereas, it carries out lifting movements for controlling the charge cycle in a second switching position. The tappet interacts with a cam of a camshaft. A locking element is associated with the clutch member and interacts with a valve stem which unlocks the locking element in a defined cam path range and when a valve stem of the valve is dipped into a bore of the clutch member.

37 Claims, 7 Drawing Sheets

INTERNAL-COMBUSTION ENGINE SWITCHABLE VALVE TAPPET

BACKGROUND AND SUMMARY OF THE INVENTION

The present invention relates to a tappet for a switchable valve, and more particularly, to a hydraulically actuated piston and a clutch member having a bore and arranged to be actuated by the piston for switching the valve off in a first switching position and for activating the valve in a second switching position for charge cycle control.

Patent Document WO-93/18 284 describes a tappet wherein, during the valve lift and when the piston is acted upon by pressure, no clear position is fixed between the valve stem and bore in the clutch member. This may result in high wear from friction as the valve stem dips into this bore. Although, in the case of a correspondingly unfavorable alignment of the valve stem relative to the bore of the clutch member, the clutch member may also take along the valve, this will only be along a partial range of the height of the lift. Under the effect of the valve spring, the valve from that position strikes back into the valve seat in an undamped manner which causes very disturbing noises and additional wear.

It is an object of the present invention to provide a tappet having a clutch member held in at least one end position in a secure and defined manner with its bore or supporting surface always aligned in a functionally appropriate manner with the valve stem.

This object has been achieved according to the present invention by providing a locking element operatively associated with clutch member, so as to interact with a stem of the valve such that, in a defined cam path range, when the valve stem is dipped or moved into the bore of the clutch member, the locking element is unlocked.

One of the principal advantages achieved by the present invention is that the locking element locks the clutch member in an end position in which the valve takes up a first switching position. Only under the influence of a defined cam path range for moving the clutch member is this locking released so that the clutch member can be released by the valve stem.

When the piston is acted upon by pressure, the clutch member is advantageously first moved into an intermediate position, and then, in a second cam path range, with the valve stem now situated outside the bore of the clutch member, the second end position of the clutch member is achieved. As a result, the change from the first switching position into the second switching position of the valve is ensured in a manner which is low in noise and wear. The reverse movement or the return of the clutch member into the first end position takes place as soon as the piston is without pressure. The locking element has a simple construction and is actuated in a forced manner by the end of the valve stem as a function of the second cam path range. In a first switching position of the valve and as a function of the cam path range, the tappet is held by the hold-down device in a position separate from the cam, whereby the friction between the cam and the tappet is reduced.

The bearing part is suitable not only for receiving the piston, the clutch member and the pressure spring in a constructively favorable manner, but it can also easily be integrated into the tappet which is constructed in a cup-like manner with a jacket part and a cup bottom. The bore for the piston and a guiding section for the clutch member can be integrated in the cup of the tappet in a bearing section, so that the bearing section and the guiding section can be a housing made in one piece with the cup. On the side facing the cam, this cup is provided with an insert which comprises a receiving device for the adjusting plate. This insert, made, for example, of an iron-metallic material, is provided with the locking element. The locking element has a locking catch which interacts with the stop of the clutch member and which is formed by a flexible tongue in the carrier plate of the insert.

The locking of the clutch member may advantageously take place by meshing parts of the clutch member and its guiding path. The locking can then be released in a simple manner by the displacement of the two structural members relative to one another (e.g., lifting by the valve stem).

The switching reliability of such a tappet can be significantly improved again if the clutch member is fixed also in its other end position by an unlockable locking element. As a result, it may be ensured that the switching operation takes place in both directions, in each direction, in a precisely defined time period or during a defined angular position of the cam. The switching operation is, therefore, carried out in a reliable and defined manner within a short time period, and increased wear is thereby excluded.

The second locking device can advantageously also be unlocked by the valve stem so that all switching functions may take place without any constructive interventions on the camshaft. This permits the use of standard camshafts. The tappets according to the present invention require the same installation space as conventional tappets without any switching device. This additional locking device may advantageously be integrated into the clutch member and its guiding path so that additional constructional expenditures are avoided and a secure functioning with a small number of components is ensured.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 1:
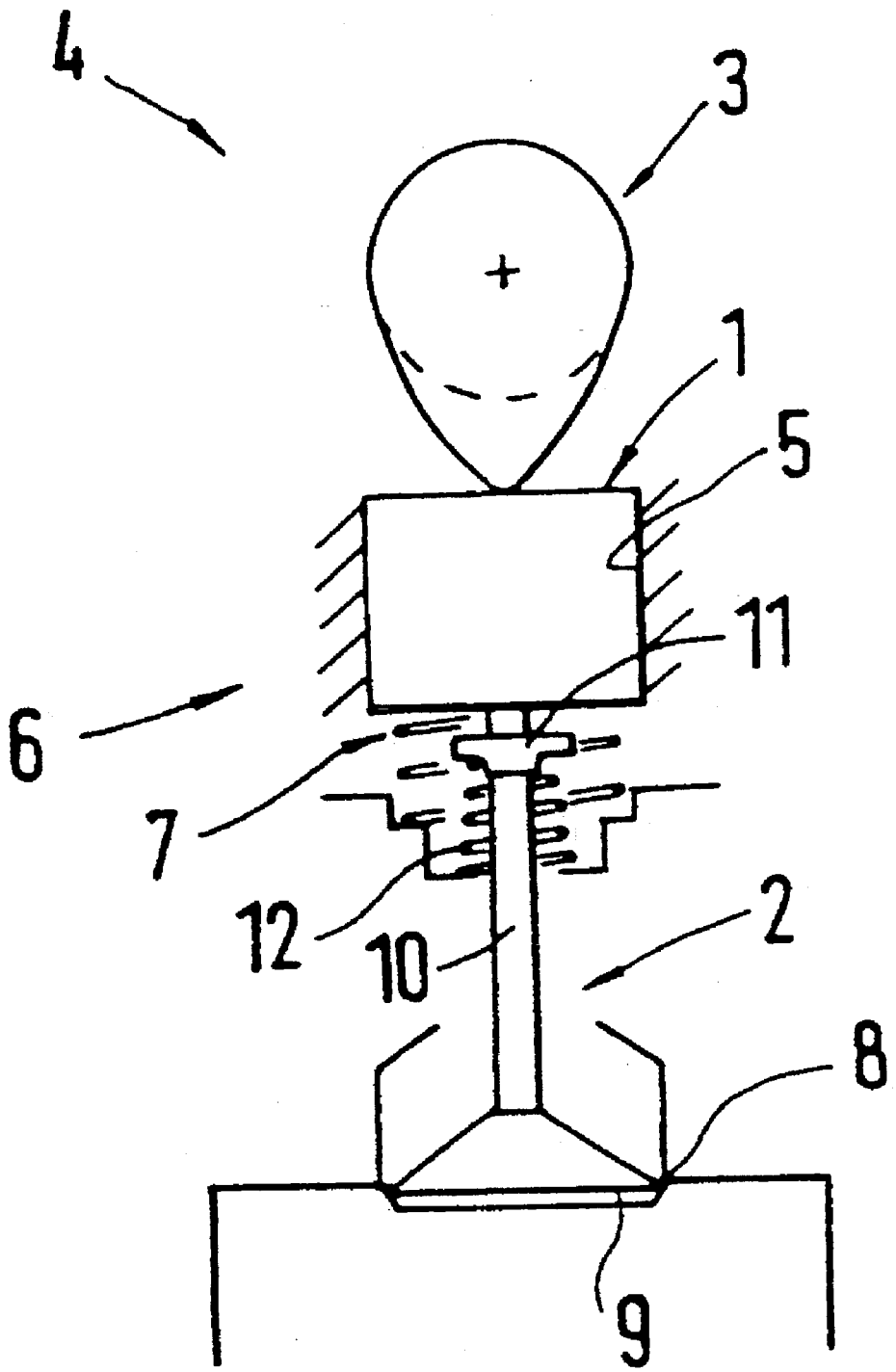
FIG. 1 is a schematic partial elevational view of an internal-combustion engine in the area of a cam drive.
Figure 2:
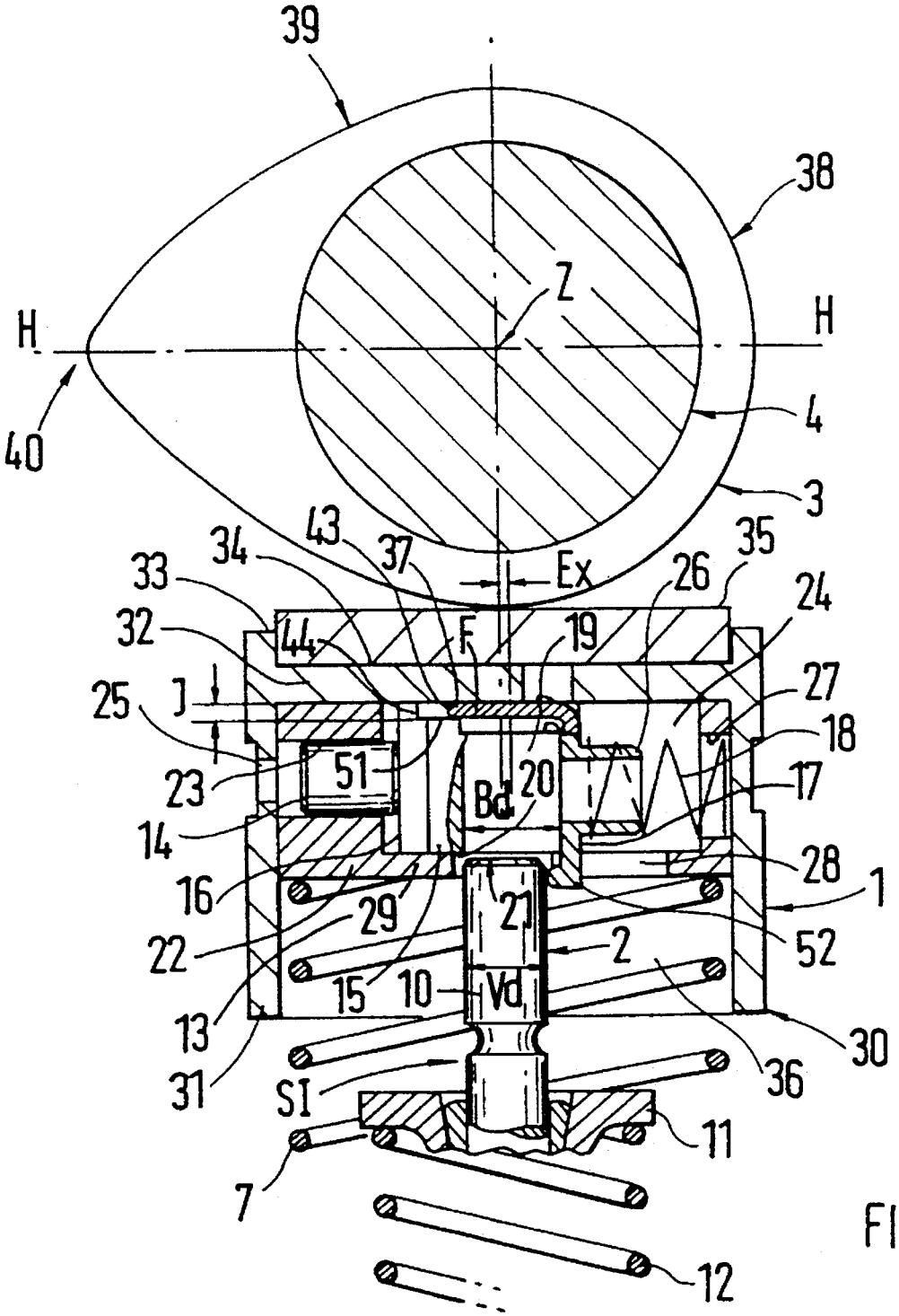
FIG. 2 is a partial cross-sectional view of an internal-combustion engine in the area of a camshaft with the tappet according to the present invention.
Figure 5:
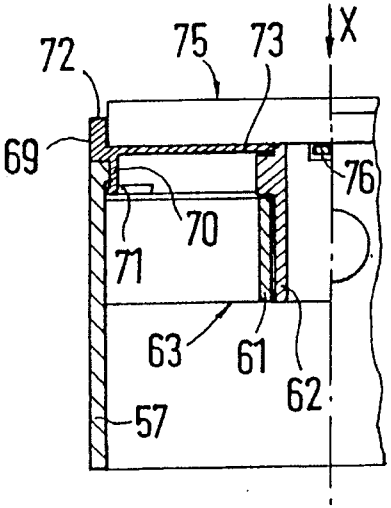
FIG. 5 is a sectional view along Line V—V of FIG. 3.
Figure 6:
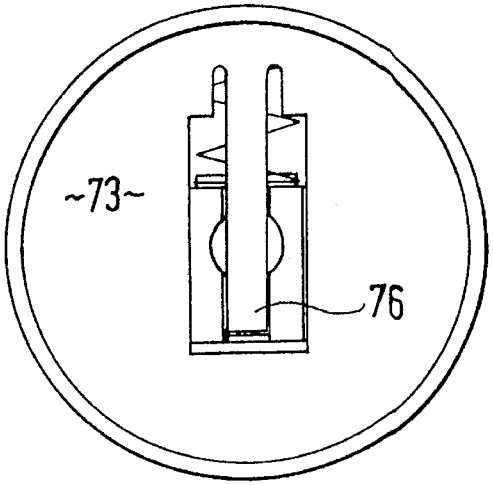
FIG. 6 is a view in the direction of the arrow X of FIG. 5.

In the area shown in FIG. 1, an internal-combustion engine (shown schematically) has a cylindrical tappet 1 which is operatively associated with a switchable valve 2 in a generally known way and is actuated by a camshaft designated generally by the numeral 4 comprising a cam 3. The tappet 1 is inserted into a bore 5 of a cylinder head 6 and is supported by a pressure spring 7. The valve 2 comprises a valve disk 9 which interacts with a valve seat 8 of the cylinder head designated generally by the numeral 6, as well as a valve stem 10 which is equipped with a valve spring retainer 11. A valve spring 12 is arranged between the valve spring retainer 11 and the cylinder head 6, and is operative to hold the valve 2 in the closed position. Inside the tappet 1, as seen in FIG. 2, a device 13 is arranged for adjusting two switching positions for the valve 2. In the first switching position SI (FIGS. 2 and 9), valve 2 rests on the valve seat 6. In the second switching position SII (FIG. 10), corresponding to the alternating movements triggered by the cam 3 and the tappet 1, the valve carries out lifting movements.

Figure 10:
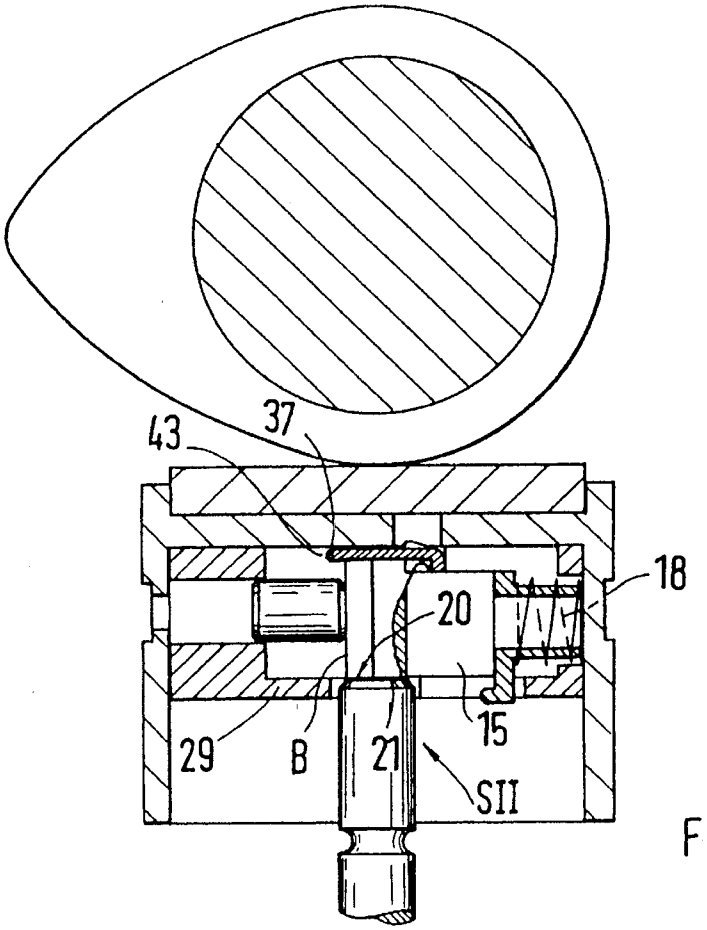

The device 13 is formed by a piston 14 and a clutch member 15 which, in the first switching position SI (FIGS. 7 and 8), takes up the end position A (FIGS. 8 and 9) and, in the second switching position SII (FIG. 10), takes up the end position B (FIG. 10). That is, the piston 14 directly moves the clutch member 15 constructed as a slide from end position A to end position B, by applying a force to an upright supporting surface 16 of the clutch member 15 (FIG. 2). A pressure spring 18 is supported on a supporting surface 17 of the clutch member 15 which is situated at a distance or away from the supporting surface 16. The pressure spring 18 seeks to move the clutch member 15 into position A. Alternatively, a hydraulically actuated piston and the like can also be utilized for this function.

Figure 8:
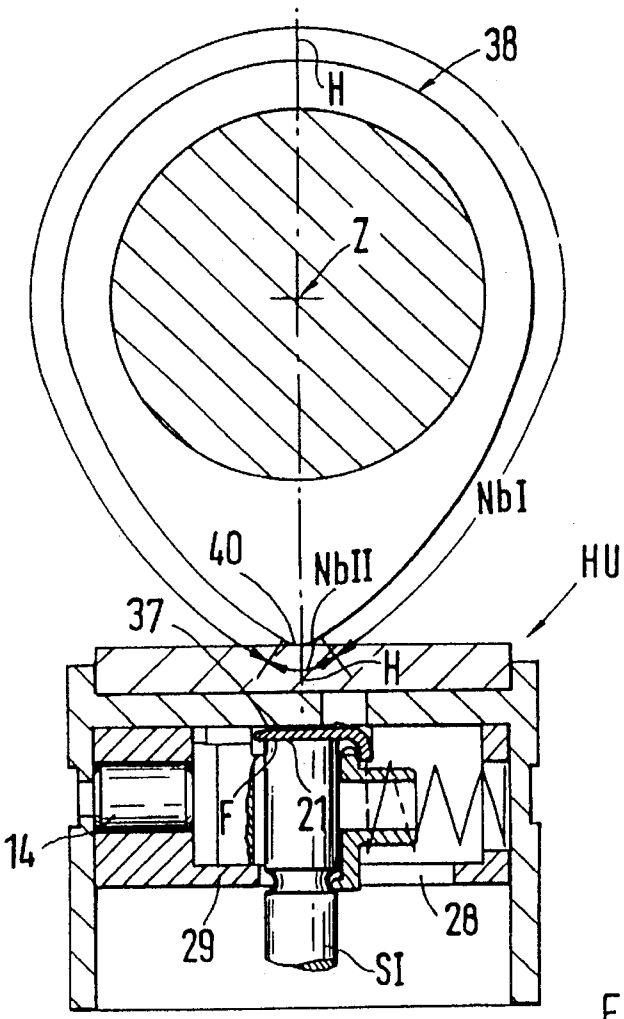
FIGS. 7 to 10 are views of different positions of a cam and of the tappet according to the present invention.
Figure 9:
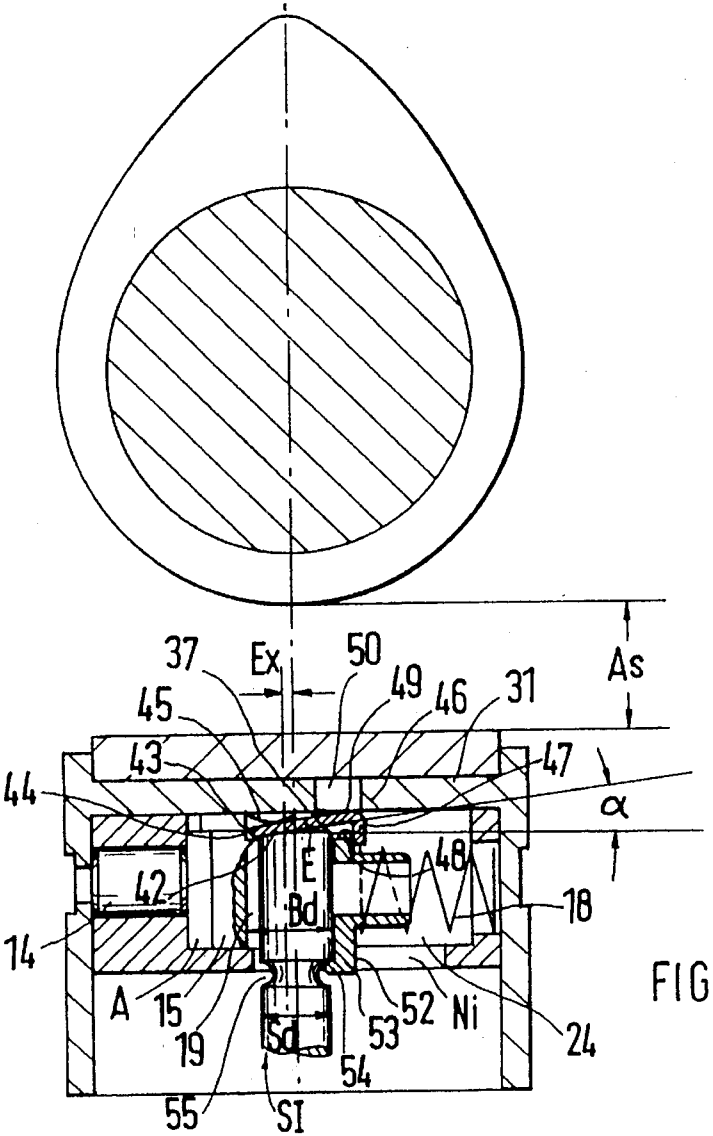

The clutch member 15 is provided with a bore 19 into which the valve stem 10 dips in the end position A of the clutch member 15, i.e. in the switching position SI of the valve 2 (FIGS. 8 and 9). On the side facing the valve 2, the clutch member 15 is provided with a supporting surface 20. The end 21 of the valve stem is supported on this supporting surface 20 when the clutch member 15 is situated in end position B or in an area close to this position (FIG. 10). The piston 14 and the clutch member 15 are installed in a bearing part 22 which has a bore 23 for the piston 14. The bearing part 22 extends in the radial direction of the tappet 1 and has a recess 24 shown as a guide in which the clutch member 15 is disposed in a relatively movable manner, i.e. between end positions A and B as seen in FIGS. 9 and 10. The piston 14 is acted upon by hydraulic medium through an opening 25 in the tappet 1 and, as described above, interacts directly with the clutch mender 15. The ends of the pressure spring 18 are received by pin 26 of the clutch member 15 or a bore 27 of the bearing part 22. In addition, the bearing part has an opening 28 which is worked into a sliding web 29 of the bearing part 22.

The tappet 1 shown in FIG. 2 is configured as a cylindrical cup 30. That is, it comprises a jacket part 31, and a cup bottom 32 which extends at a narrow distance from a side 33 of the cup 30 adjacent to the cam 3 and is constructed as a receiving device 34 for An adjusting plate 35. The bearing part 22 is arranged inside the relatively large space 36 which is therefore created in the tappet 1. The bearing part 22 can be constructed as an insert which is fastened in the space 36 by the suitable devices.

Figure 7:
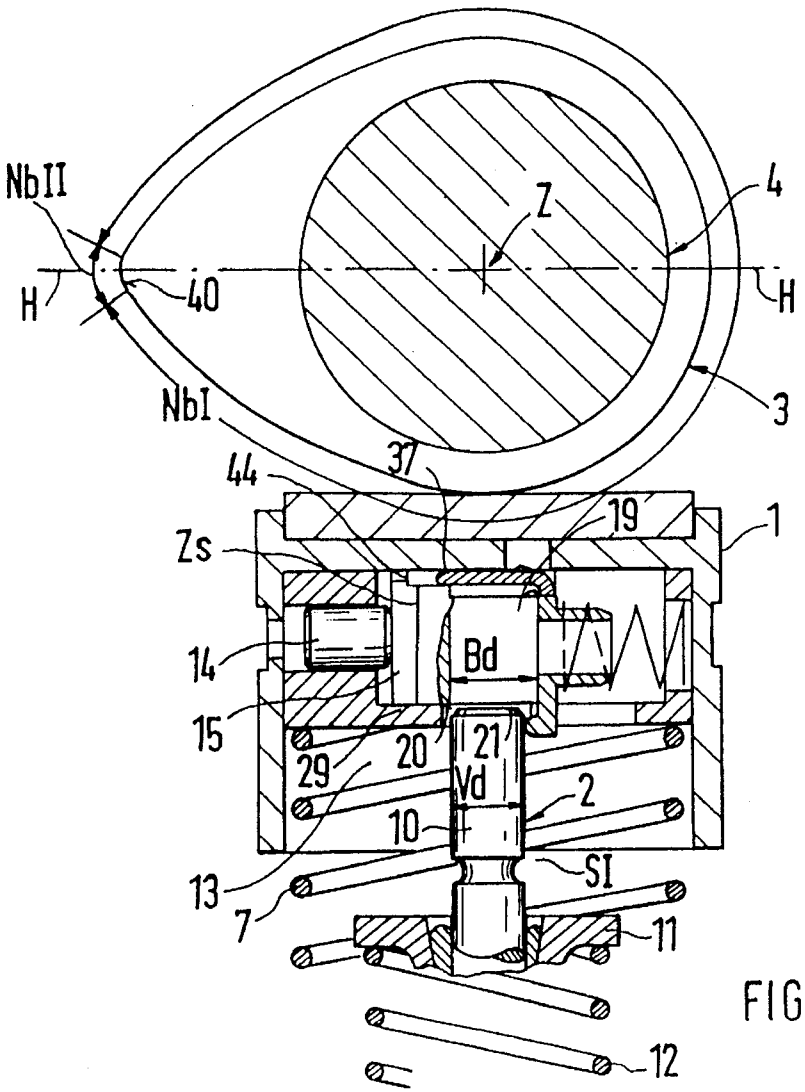

By way of a locking element 37, the clutch member 15 is fixed in a first end position A (FIG. 9) if the piston 14 is without pressure, the valve 2 takes up the first switching position SI, and a cam path range NbI (FIGS. 7 and 8), which extends along a cam base circle 38 and a cam flank 39 faces the tappet 1 and affects it. In a second cam path range NbII, which includes the cam tip 40, which is situated on a longitudinal center plane H—H of the cam 3 intersecting the center Z of the cam shaft 4, and the first switching position SI of the valve stem 2, the valve stem 10 dipped into the bore 19, unlocks the locking element 37 via the end 21 thereof. As a result, when the piston 14 is acted upon by pressure, the clutch member 15 is moved against the effect of the pressure spring 18 from the position A into the position Zs (FIG. 7). This is achieved by the diameter Bd of the bore 19 being larger than the diameter Vd of the valve stem 10 or the bore 19 extending with the eccentricity Ex to the valve stem 10 (FIG. 2). As soon as the valve stem 10 opens up the bore 19 in that the cam path range NbI with the cam base circle 38 faces the tappet 1, the clutch member 15 is moved into the second end position B. When the piston 14 is without pressure, the clutch member 15 is returned into its first end position A by the pressure spring 18.

The locking element 37 inserted between the cup bottom 32 and the bearing part 22 comprises a locking catch 42 which faces the end 21 of the valve stem 10 and is spring-movable and angularly movable and, by way of its locking catch end 43, is aligned with a stop 44 of the clutch member 15 as seen in FIG. 9. The end 21 of the valve stem 10 actuates the locking catch 42 from the locking position E (FIG. 9) into the unlocking position F (FIG. 2) against the effect of a spring 45. The locking catch 42 carries out angular movements in the area of an angled portion. On the side facing away from the locking catch 42, the locking element 37 is disposed in the manner of a hinge at a location designated by reference numeral 46. An angle portion 47 of the locking catch 42 reaches behind a nose 48 of the clutch member 15, in which case a recess 50 is provided in the cup bottom 31 for swivel movements of the locking element 37. In the unlocking position F (FIG. 2), the locking catch 42 rests on a supporting path 51 of the clutch member 15 which extends at a parallel distance J from the cup bottom 31.

A hold-down device 52, which holds the tappet 1 in position in the first switching position SI of the valve 2 at a distance As on the valve 2, is connected with the clutch member 15 as seen in FIG. 9. The hold-down device 52, which is connected in one piece with the clutch member 15, has a lengthened portion 53 which extends in parallel to the valve 2 and on whose free end an extension 54 is provided. In the position Ni, in which the tappet 1 is held on the valve stem 10 by the hold-down device 52, the extension 54 engages in a groove 55 of the valve stem 10.

Figure 3:
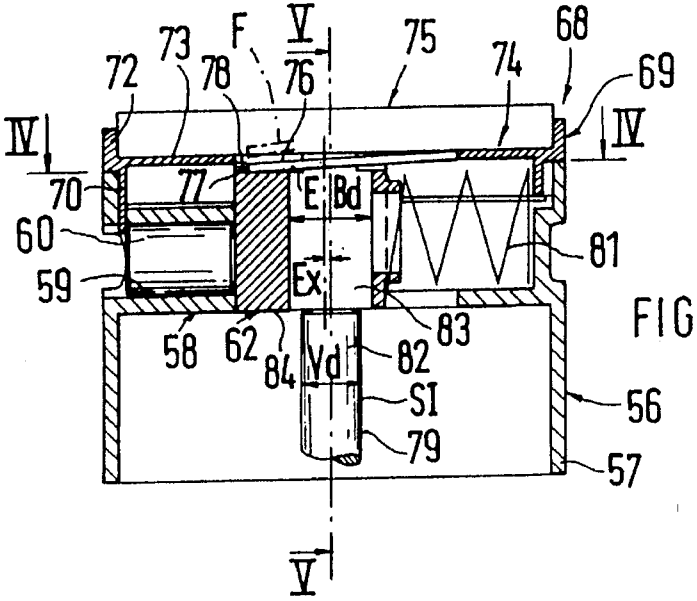
FIG. 3 is a partial view of the tappet according to another embodiment of the present invention.
Figure 4:
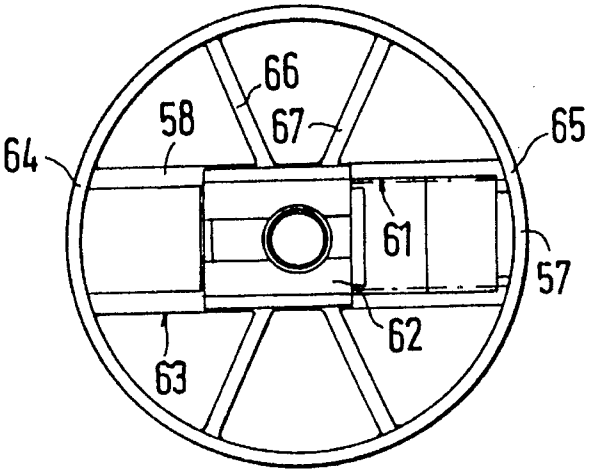
FIG. 4 is a sectional view along Line IV—IV of FIG. 3.

According to the embodiment shown in FIG. 3, the tappet 56 comprises a jacket part 57 which is provided with a bearing section 58 for a bore 59 of a piston 60 and of a guiding section 61 for a clutch member 62. The bearing section 58 and the guiding section 61 are provided on a support 63 which connects opposite areas 64, 65 of the jacket part 57 with one another. Furthermore, the support 63 is supported by radially extending webs 66, 67 with respect to the jacket part 57.

On the side 68 facing a cam (not shown), the jacket part 57 is provided as an insert 69 constructed as a closing part. The insert 69 is made of steel and projects by way of a first collar 70 into the jacket part 57. At the area designated by reference numeral 71, the collar 70 is caulked so that the insert 69 is held in position in a form-locking manner. A second collar 72 extends in the opposite direction and, together with a carrier plate 73, forms a receiving device 74 for an adjusting plate 75. A locking element in the form of a locking catch 76 is provided on the carrier plate 73 and, in the locking position E, is aligned with a stop 77 of the clutch member 62. The locking catch 76 rests on a supporting path 78, which is a flexible tongue of the carrier plate 73, when the valve 79 takes up the switching position SI, the piston 80 is acted upon by pressure against the effect of the spring 81, and the cam path range NbII rests against the tappet 56. Under these conditions, the unlocking position F of the locking catch 76 occurs as seen in FIG. 3 in dot-dash line.

In FIG. 3, the piston 60 is without pressure in the first switching position SI. The hydraulic medium is not operative; and a valve stem 82 can enter into a bore 83 of the clutch member 62. Hence, the valve 79 is stopped. However, the clutch member 62 can also be constructed such that, when the piston 80 is without pressure, the valve stem 82 is supported on a supporting surface 84 of the clutch member 62, and the valve 79 is thence activated.

In the case of the third embodiment of the tappet according to the present invention illustrated in FIGS. 11 to 15, the valve is switched off when the piston is acted upon by pressure and, when the piston is not pressurized, the valve is activated in the other end position of the clutch member. Furthermore, this third embodiment differs from the two above-described embodiments by an additional locking device in which the clutch member is also releasably locked in its second end position. For a better and simplified explanation of the invention, identical or similar constructional elements are provided with the corresponding reference numbers of the above-described embodiments.

The tappet 1 of this third embodiment is also constructed in the shape of a cup 30. The piston 14 for actuating the clutch member 15 is guided in an extension 85 of the jacket part 31 projecting into the interior of the cup 30. The space 36 is closed off on its underside by a guiding plate 86 which rests against a surrounding step 87 on the interior side of the jacket part 31. The guiding plate 86 is provided with an opening 88 through which the valve stem 10 penetrates in the case of a corresponding position of the clutch member 15. The side of the guiding plate 86 facing the clutch member 15 is constructed as a guide path 89 on which the clutch member 15 can be moved in a sliding manner by the interaction of the piston 14 and the pressure spring 18.

Figure 11:
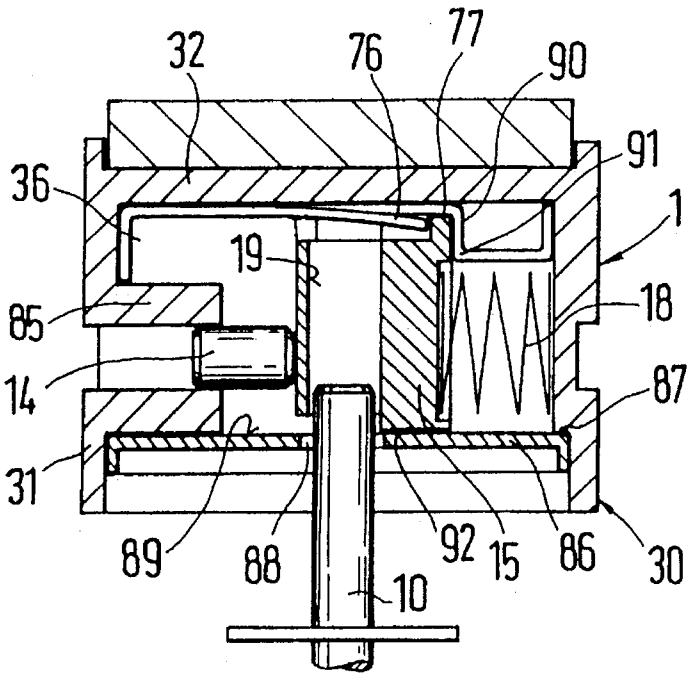
Figure 15:
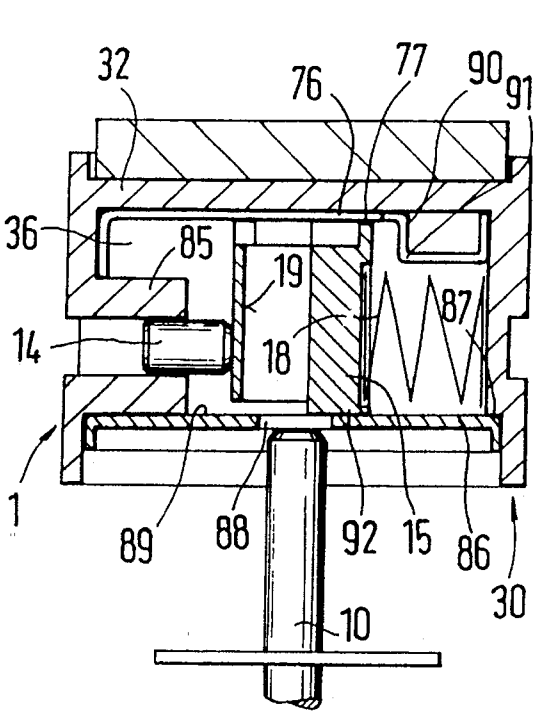
Figure 14:
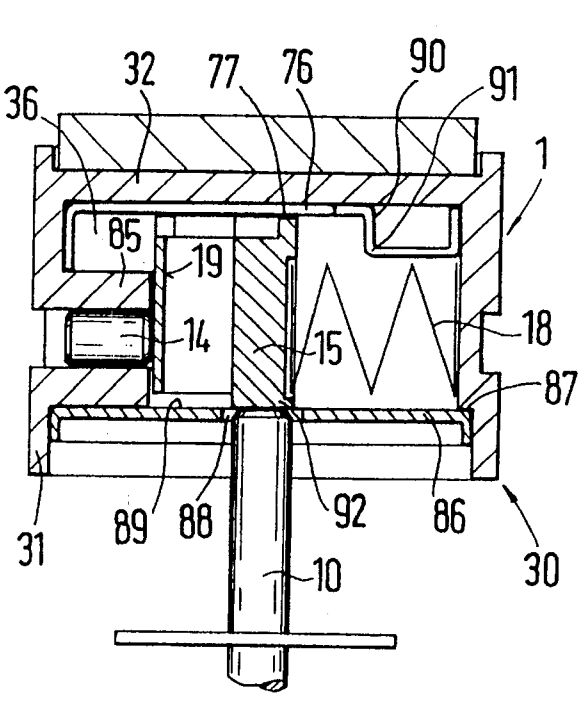

A plate-shaped preform 90 is also inserted into the space 36 and rests against the interior side of the cup bottom 32. Similar to the second embodiment, the locking catch 76, as a flexible tongue, is also punched out of this preform 90. The preform 90 also contains guiding paths (not shown in detail) in which the clutch member 15 is guided. Also, a deeper-set section 91 is constructed on the preform 90 and is used as an end stop for the clutch member 15. When, as illustrated in FIG. 11, the clutch member 15 rests against the section 91, the locking catch 76 interacts with the stop 77 of the clutch member 15. In this end position of the clutch member, the valve stem 10 can dip through the opening 88 in the guiding plate 86 into the bore 19 of the clutch member 15.

Figure 13:
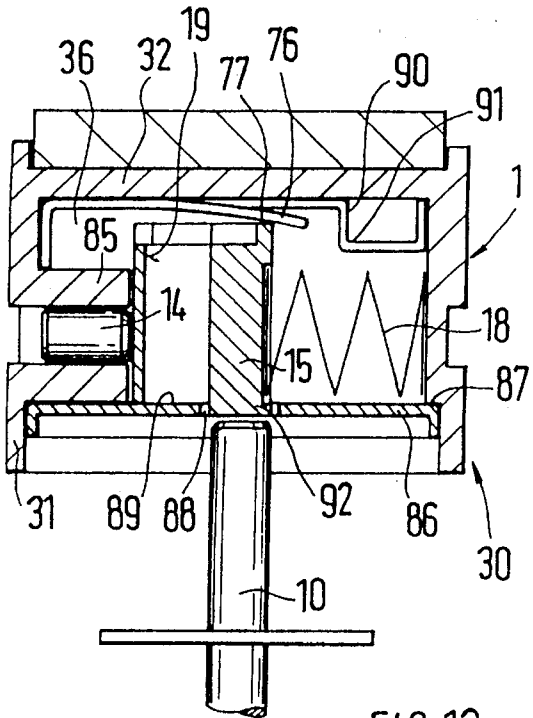

The underside of the clutch member 15 facing the guiding plate 86 is provided with an extension 92 whose dimensions in this embodiment correspond approximately to those of the valve stem 10, and which, in the other end position of the clutch member 15 illustrated in FIG. 13, dips into the opening 88. By virtue of the flexible effect of the locking catch 76 which rests on the top side of the clutch member 15, the clutch member 15 is pressed against the guide 89 so that, in the case of the corresponding positioning, the extension 92 dips into the opening 88 and the clutch member 15 is correspondingly lowered and held.

Although the following description of the switching operation takes place with reference to the first embodiment, that description also generally applies to the second and third embodiments.

If the cam path range NbII or the cam tip 40 moves the tappet 1 into its maximally lower lifting position HU, as seen in FIG. 8, and the valve 2 is in the stopped switching position SI, the locking catch 42 is moved from the end 21 of the valve stem 10 into the unlocking position F. If now no pressure is applied to the piston 14, the pressure spring 18 holds the clutch member in the end position A. With the following partial rotation of the cam into the position illustrated, for example, in FIG. 9, the tappet 1 (when the hold-down device 52 does not exist) rests against the cam path range NbI, whereby the valve stem 10 emerges from the bore 19. If the clutch member 15 is equipped with the hold-down device 52, the tappet 1 takes up a position at a distance As from the cam 3 in which the friction is reduced.

If the piston 14 is acted upon by pressure and the cam path range NbII or the cam tip 40 rests against the tappet 1 (again with reference to FIG. 8) and if, in addition, the valve 2 is in the switching position SI, the locking catch 42 is moved from the end 21 of the valve stem 10 again into the unlocking position F, and the clutch member 15 is brought by way of the piston 14 first into the intermediate position Zs (FIGS. 2 and 7) in which the clutch member 15 rests against the valve shaft 10, and the hold-down device 52 is moved out. The locking catch 42 now rests upon the supporting path 51, and the clutch member 15 is therefore unlocked. As soon as the valve stem has completely moved out of the bore 19 (FIGS. 2 and 7), the clutch member 15 slides free. That is, without any frictional engagement with the end 21 of the valve stem 10 and by way of the cam base circle 38 or a partial area thereof, the clutch member 15 slides on the sliding web 29 from the intermediate position Zs into the second end position B. Now the end 21 is supported on the supporting surface 20. The valve 2 is in the switching position SII (FIG. 10), and the pressure spring 18 is maximally tensioned. When the piston 14 is not subjected to pressure, the pressure spring 18 moves the clutch member 15 back into the end position A.

When, in the third embodiment of the tappet according to FIGS. 11 to 15 of the present invention, the clutch member 15, after the piston 14 is acted upon by pressure, is in its first or right end position, the valve is switched off. The clutch member 15 is held in this end position by the interaction of the locking catch 76 and of the stop 77 against the effect of the pressure spring 18. When the piston 14 is relieved, the clutch member 15 can be pushed back by way of the pressure spring 18 into its second (left) end position, if the locking between the locking catch 76 and the stop 77 on the clutch member 15 is released by the valve stem 10 analogously to the above-described method of operation.

Figure 12:
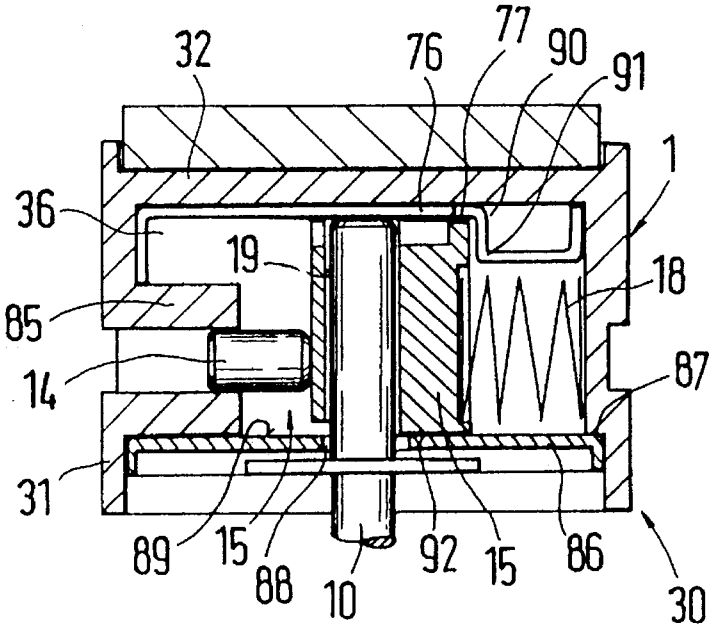
FIGS. 11 to 15 are sectional views of the tappet according to a third embodiment of the present invention in different positions.

By way of the intermediate position Zs, the clutch member 15 is pushed back into the second or left end position (FIGS. 11 to 13). When the clutch member 15 is situated in its second or left end position (FIG. 13), it is pressed down by the flexible effect of the locking catch 76 that the extension 92 dips into the opening 88. When, in this position of the clutch member 15, the piston 14 is acted upon by pressure, the clutch member can be displaced only until the extension 92 rests against the edge of the opening 88. This ensures a locking in this second end position. The valve stem 10 rests against the clutch member 15 or on the extension 92, and the valve is now activated. This locking can also be released by the valve stem.

As long as the cam 3 interacts with the adjusting plate 35 in the area of its base circle 38, the tappet 1 is in the position illustrated in FIG. 13. By the running of the cam flank 39 onto the adjusting plate 15, the tappet is pressed into the position illustrated in FIG. 14 until the clutch member 15 is pressed by the valve stem 10 penetrating the opening 88 against the elastic effect of the locking catch 76 to rest against the cup bottom 32. The extension 92 is situated completely outside the opening 88. Because of the occurring friction forces during the rising part and almost the entire descending part of the interaction of the cam flank 39 and the adjusting plate 35, the clutch member 15 is held in this position. In the adjoining transition area from the cam flank 39 to the base circle 38, when the corresponding pressure acts upon the piston 14, this piston can displace the clutch member 15 against the effect of the pressure spring 18 toward the right so that the extension 92 is displaced by the end of the valve stem 10 on the guide 89 until the clutch member 15 comes to rest on the section 9 of the preform 90, the locking catch 76 locks the clutch member 15, and the valve is switched off again.

Furthermore, it is also within the contemplation of the present invention to use the locking with the extension 92 and the opening 88 as the sole locking in only one end position of the clutch member 15 (valve activated or valve switched off) analogously to the two first embodiments.

If the tappet is provided on all valves of a cylinder bank of an internal-combustion engine, which comprises, for example, two cylinder banks, this cylinder bank can be switched on and off as a function of internal-combustion engine parameters. This feature has a favorable effect on the fuel consumption and exhaust gas emission. On the other hand, the present invention also contemplates disconnecting individual valves from cylinders which comprises more than two valves for an outlet and inlet multiple valve arrangement.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A tappet for a switchable valve of an internal-combustion engine and interacting with a camshaft cam, comprising a hydraulically actuated piston and a clutch member having a bore and arranged to be actuated by the piston for deactivating the valve in a first switching position and for activating the valve in a second switching position for charge cycle control, and a locking element operatively associated with said clutch member such that, in a defined cam path range, when the valve stem is dipped into the bore of the clutch member, the locking element is unlocked by said stem.

2. The tappet according to claim 1, wherein, in a first cam path range and in one of the switching positions of the valve, the locking element is arranged to fix the clutch member in a first end position and, in a second cam path range constituting the defined cam path range in the one switching position, the locking element is actuatable by the valve stem, whereby the piston is pressure actuatable, and together with a spring, moves the clutch member from the first end position first into an intermediate position and moves the clutch member in the following first cam path range into a second end position so as to be guided back in the first cam path range into the first end position.

3. The tappet according to claim 1, wherein the locking element comprises a locking catch arranged to face an end of the valve stem and configured to be flexible, angularly movable and aligned by a locking catch end with a stop of the clutch member.

4. The tappet according to claim 3, wherein, in a first cam path range and in one of the switching positions of the valve, the locking element is arranged to fix the clutch member in a first end position and, in a second cam path range constituting the defined cam path range in the one switching position, the locking element is actuatable by the valve stem, whereby the piston is pressure actuatable, and together with a spring, moves the clutch member from the first end position first into an intermediate position and moves the clutch member in the following first cam path range into a second end position so as to be guided back in the first cam path range into the first end position.

5. The tappet according to claim 3, wherein the locking catch, in the second cam path range, is arranged to be brought by the end of the valve stem dipped into the bore of the clutch member from a locking position into an unlocking position.

6. The tappet according to claim 1, wherein the clutch member has spaced supporting surfaces on which the piston and the pressure spring are operatively supported.

7. The tappet according to claim 1, wherein, a hold-down device arranged to interact with the valve stem fixes the tappet in the first switching position.

8. The tappet according to claim 7, wherein an extension of the hold-down device projects into a groove of the valve shaft.

9. The tappet according to claim 7, wherein the hold-down device is unitary with the clutch member.

10. The tappet according to claim 2, wherein the diameter of the bore for the valve stem in the clutch member for obtaining the intermediate position is larger than the diameter of the valve shaft.

11. The tappet according to claim 3, wherein the locking element is disposed on a side facing away from the locking catch by a hinge-like angle portion.

12. The tappet according to claim 1, wherein the clutch member is inserted into a bearing part having a bore for the piston and a sliding web for the clutch member, which sliding web is provided with an opening for the valve shaft.

13. The tappet according claim 12, wherein a lower end of the pressure spring interacts with receiving devices of the clutch member and of the bearing part.

14. The tappet according to claim 12, wherein the tappet has a cup-like configuration and comprises a jacket part and a bottom, on a side thereof facing the cam, is configured as a receiving device for an adjusting plate, the bearing part with the piston, the locking element, the clutch member and the pressure spring being inserted in a space thereof.

15. The tappet according to claim 14, wherein the locking element is arranged between the bottom and the clutch member.

16. The tappet according to claim 14, wherein the clutch member has a supporting path for the locking catch, which supporting path extends at a distance from the bottom.

17. The tappet according to claim 15, wherein the locking element is arranged between the bottom and the clutch member.

18. The tappet according to claim 1, further comprising a jacket part with a bearing section for a bore of the piston and a guiding section for the clutch member.

19. The tappet according to claim 18, wherein the bearing section and the guiding section are unitary with the jacket part.

20. The tappet according to claim 19, wherein the bearing section and the guiding section are arranged on a support connecting opposite jacket areas.

21. The tappet according to claim 20, wherein the support is supported by webs in relation to the jacket part.

22. The tappet according to claim 18, wherein the jacket part has, on a side facing the cam, an insert with a receiving device for an adjusting plate.

23. The tappet according to claim 22, wherein the insert, in the area of a carrier plate for the adjusting plate, comprises the locking element configured as a flexible tongue.

24. The tappet according to claim 22, wherein the insert is made of an iron-metallic material.

25. The tappet according to claim 24, wherein the insert, in the area of a carrier plate for the adjusting plate, comprises the locking element configured as a flexible tongue.

26. The tappet according to claim 1, wherein, in a second end position, the clutch member interacts with an additional locking device configured and arranged to be unlocked by the valve stem.

27. The tappet according to claim 26, wherein the clutch member is displaceably arranged on a guiding path and liftable by the valve stem approximately perpendicularly thereto, and the second locking device comprises releasably meshing parts of the clutch member and of the guiding path.

28. The tappet according to claim 26, wherein the guiding path has an opening into which an extension of the clutch member engages in the locking position of the additional locking device.

29. A tappet interacting with a camshaft cam for a switchable valve of an internal-combustion engine, comprising a hydraulically actuated piston, and a clutch member arranged to be actuated by the piston for deactivating the valve in a first switching position and for activating the valve in a second switching position for charge cycle control, wherein the clutch member is displaceably arranged on a guide and is arranged to be lifted by a stem of the valve approximately perpendicularly thereto, and the clutch member is locked in an end position by releasably meshing parts of the clutch member and the guide.

30. The tappet according to claim 29, wherein the clutch member is arranged to be lifted by the valve stem against the effect of a spring element.

31. The tappet according to claim 30, wherein the spring element constitutes the locking element.

32. The tappet according to claim 31, wherein the locking element is arranged on a preform insertable into the tappet which is cup-shaped.

33. The tappet according to claim 32, wherein the guide is arranged on a guiding plate insertable into the cup-shaped tappet, which guiding plate is arranged to be penetrated by the valve stem, and the clutch member is displacably arranged on the guiding plate.

34. A tappet for a switchable valve of an internal-combustion engine and interacting with a camshaft cam, comprising a hydraulically actuated piston and a clutch member having a bore and arranged to be actuated by the piston for switching the valve between a first switching position and a second switching position for charge cycle control, and a locking element operatively associated with said clutch member such that, in a defined cam path range, when the valve stem is dipped into the bore of the clutch member, the locking element is unlocked by said stem.

35. The target according to claim 34, wherein the first switching position constitutes a fully deactivated position of the valve, and the second switching position constitutes a fully activated position of the valve.

36. A tappet interacting with a camshaft cam for a switchable valve of an internal-combustion engine, comprising a hydraulically actuated piston, and a clutch member arranged to be actuated by the piston for switching the valve between a first switching position and a second switching position for charge cycle control, wherein the clutch member is displaceably arranged on a guide and is arranged to be lifted by a stem of the valve approximately perpendicularly thereto, and the clutch member is locked in an end position by releasably meshing parts of the clutch member and the guide.

37. The target according to claim 36, wherein the first switching position constitutes a fully deactivated position of the valve, and the second switching position constitutes a fully activated position of the valve.

* * * * *